United States Patent [19]

Billenstein et al.

[11] 4,351,737

[45] Sep. 28, 1982

[54] FABRIC SOFTENER CONCENTRATE

[75] Inventors: Siegfried Billenstein, Burgkirchen; Adolf May, Hofheim am Taunus; Hans-Walter Bücking, Kelkheim, all of Fed. Rep. of Germany

[73] Assignee: Hoechst Aktiengesellschaft, Frankfurt, Fed. Rep. of Germany

[21] Appl. No.: 277,909

[22] Filed: Jun. 26, 1981

[30] Foreign Application Priority Data

Jul. 4, 1980 [DE] Fed. Rep. of Germany ..... 3025369

[51] Int. Cl.[3] ..... D06M 13/40; D06M 13/46

[52] U.S. Cl. ..... 252/8.8

[58] Field of Search ..... 252/8.8

[56] References Cited

U.S. PATENT DOCUMENTS

| | | | |
|---|---|---|---|
| 4,060,505 | 11/1977 | Ciko et al. | 252/8.8 |
| 4,155,855 | 5/1979 | Goffinet et al. | 252/8.8 |
| 4,162,984 | 7/1979 | DeBlock et al. | 252/8.8 |
| 4,179,382 | 12/1979 | Rudkin et al. | 252/8.8 |

*Primary Examiner*—Maria Parrish Tungol

*Attorney, Agent, or Firm*—Connolly and Hutz

[57] ABSTRACT

Fabric softener concentrates, which contain of from (a) about 30 to 70 weight % of a cationic softener, (b) about 5 to 50 weight % of a non-ionic softener, (c) about 5 to 20 weight % of a non-ionic dispersing agent, (d) about 5 to 30 weight % of a $C_1$-$C_3$-alkanol, (e) about 5 to 30 weight % of a liquid glycol, polyglycol or an alkyl ether thereof, and (f) water and optionally perfume and dyestuffs, in quantities representing the remainder to 100 weight %.

2 Claims, No Drawings

FABRIC SOFTENER CONCENTRATE

It is known that certain cationic quaternary ammonium salts, when aded to the last rinsing bath of a washing machine, impart an agreeable feel and simultaneously good antistatic properties to the most diverse fabrics, for example those made of cotton, wool or of cotton and synthetic fibers. The preparation of fabric softener compositions of relatively high concentration and their homogenous dispersion in the cold rinsing bath involves some difficulties, however, since, upon addition of softeners in the form of concentrated aqueous or alcoholic solutions, there are formed gelatinous precipitates, which may lead to the formation of stains on the fabric. It is moreover difficult to dilute such a concentrate to obtain a commercial composition of from 2 to 5% strength. In most cases there is obtained a gel-like mixture, that is difficultly dispersible in cold water or is not at all dispersible.

Fabric softeners have therefore been used in general in the form of dilute aqueous solutions of about 2 to 10% strength. These dilute solutions have a number of disadvantages, however. For example, they cannot be stored at low temperatures, since they become gelatinous, upon freezing and defrosting, so that a homogeneous dissolution thereof is no longer possible.

A further disadvantage of said known fabric softeners resides in their high water content, which is superfluous.

It has now been found that it is possible to prepare liquid, concentrated compositions of fabric softeners, which do not have the disadvantages of the dilute solutions and can be readily dispersed in cold rinsing water.

Subject of the present invention therefore are liquid fabric softener concentrates, which contain of from:

(a) about 30 to 70, preferably 40 to 50, weight % of a cationic softener, (b) about 5 to 50, preferably 30 to 40, weight % of a non-ionic softener, acting simultaneously as dispersing agent, (c) about 5 to 20, preferably 5 to 10, weight % of a non-ionic dispersing agent, (d) about 5 to 30, preferably 5 to 10, weight % of a $C_1$–$C_3$-alcohol, in particular isopropanol, (e) about 5 to 30, preferably 5 to 10, weight % of a liquid glycol, polyglycol or a $C_1$–$C_4$ alkyl ether thereof, in particular butyl diglycol, ethylene glycol or 1,2-propanediol and (f) water and optionally perfume and dyestuffs, in quantities representing the remainder to 100 weight %.

Suitable cationic softening components of the fabric softener concentrates according to the invention include quaternary ammonium compounds containing the lipophilic radicals, that are known for this application, for example those as described in Chemistry and Industry, July 1969, page 893/894, in particular compounds characterized by the general formulae I, II and III.

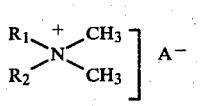

I

-continued

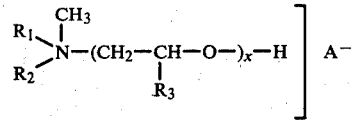

II

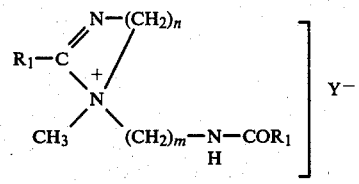

III

The symbols in the above formulae have the following meanings:

$R_1$ and $R_2$ each denotes alkyl or alkenyl of from 8 to 20 carbon atoms, in particular radicals having a carbon chain distribution as can be found, for example in coconut fatty alkyl, tallow fatty alkyl, oleic acid alkyl, sperm oil fatty alkyl, $R_3$ is hydrogen or alkyl of from 1 to 3 carbon atoms, in particular hydrogen or methyl, x in an integer of from 1 to 5, preferably 1, m and n each is 2 or 3, preferably 2, $A^-$ is chlorine or bromine, preferably chlorine, and $Y^-$ is chlorine or methosulfate.

These cationic softenting components are advantageously used in the form of concentrated solutions in alcohols, preferably isopropanol, or in admixture with these alcohols and water, in the preparation of the liquid softeners concentrates according to the invention. The concentrates according to the invention therefore contain a certain quantity of these lower alcohols.

As a further substantial component of the fabric softener there of used, as non-ionic dispersing agent, a reaction product of a fatty acid ethanol amide with ethylene oxide of the formula IV:

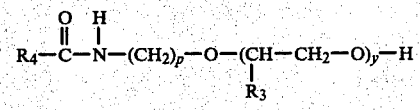

IV wherein $R_4$ is alkyl or alkenyl of from 8 to 22, preferably 8 to 16, carbon atoms, $R_3$ is hydrogen or alkyl of from 1 to 3 carbon atoms, in particular hydrogen or methyl, p is an integer of from 1 to 5, preferably 2 and Y is an integer of from 1 to 15, preferably 5 to 8, it being a decisive factor that this component is a nitrogen-containing substance having a pseudo-cationic character.

The substantivity on a fabric of this type of compounds when used alone, is too low. In combination with a quaternary ammonium compound of any of the formulae I to III, however, said non-ionic compound is absorbed by the textile material, thus imparting an additional soft feel to the fibers. These non-ionic types of softeners simultaneously act as dispersing agents or emulsifiers.

The fabric softener concentrates according to the invention further contain the usual non-ionic dispersing agents or emulsifiers based on oxalkylates that also favor a good dispersion of the concentrate in cold water. Suitable non-ionic dispersing agents are, for example, reaction products of from 2 to 12 mols of ethylene oxide with an alkyl phenol, such as xylenol, or with an alkyl phenol, the alkyl moiety of which has of from 8 to 10 carbon atoms, or with a fatty alcohol of from 8 to 15 carbon atoms, in particular reaction products of from 5 to 8 mols of ethylene oxide with 1 mol of alkyl phenol or of 1 mol of a fatty alcohol of from 8 to 15 carbon atoms or finally a mixture of said fatty alcohols.

The fabric softener concentrates according to the invention may be prepared by simply mixing the components or concentrated solutions thereof. Optionally there may be added perfume, dyestuffs, optical brighteners or further auxiliaries. The concentrate is optionally diluted with water until the desired final concentration has been reached. The quantities of the individual components (a) to (e) are chosen within in given limits such that the ready-to-use concentrate, including possibly present quantities of water, perfume and dyestuffs represents 100 weight %.

The feed quantitiy of the fabric softener concentrates according to the invention is from about 10 to 20 g, per 4 kg of fabric. This corresponds to a quantity of from about 50 to 100 ml of a commercial fabric softeners containing 5% of active ingredient, with regard to the softenting effect.

The fabric softener concentrates according to the present invention, which have good softenting properties, may be readily dispersed in cold water, without a detrimental gel formation being observed. It is advantageous that these concentrates may be introduced direct in household washing machines using suitable metering means. This good solubility enables the concentrates according to the invention to be diluted only shortly before introducing them into the washing machine and the fabric softeners can hence be marketed in the concentrated form according to the invention and no longer as dilute aqueous solutions, as in the past. Thus, there is no longer the necessity of transporting considerable superfluous quantities of water at all stages of the commerce.

The following examples serve to illustrate the invention:

EXAMPLE 1

A liquid fabric softener concentrate is prepared by intensively mixing the following components:

75 g of a 75 weight % solution of di-tally-fatty alkyl-monomethylmonooxopropylammonium chloride in isopropanol,
10 g of an addition compound of 5 mols of ethylene oxide to 1 mol of xylenol,
5 g of polethylene glycol having a molecular weight of 400,
5 g of isopropanol,
5 g of an addition compound of 5 mols of ethylene oxide to 1 mols of coconut fatty monoethanol amide, optinally perfume and dyestuffs.

The product is clear and liquid and may be dispersed in cold water.

The solution is stable and does not disintegrate during a storage test at a temperature between +5° C. and 50° C. A cotton fabric (terry fabric) that had been subjected to a washing machine test in a household washing machine using of from 8 to 15 ml of the fabric softener concentrate in the last rinsing bath per 4 kg of fabric (referred to the weight of the dry fabric) showed good feel properties.

10 g of the fabric softener ceoncentrate according to Example 1 are equal to about 80 ml of a commercial liquid fabric softener containing 5 weight % of active ingredient, as regards the softening effect reached.

EXAMPLE 2

By proceding in the manner described in Example 1 there are prepared fabric softener concentrates of the following composition:

(a)
67 g of a 75 weight % solution of di-tallow-alkyl-monomethylmonooxopropylammonium chloride in isopropanol/water (60:40)
10 g of an addition compound of 5 mols of ethylene oxide to 1 mol of xylenol,
10 g of polyethylene glycol having a molecular weight of 400,
8 g of isopropanol,
5 g of an addition compound of 5 mols of ethylene oxide to 1 mol of coconut fatty acid monomethanol amide.

(b)
77 g of a 75 weight % solution of di-tallow fatty alkyl-monomethylmonooxopropylammonium chloride in isopropanol,
5 g of butyl diglycol,
8 g of isopropanol,
5 g of an addition compound of 5 mols of ethylene oxide to 1 mol of coconut fatty acid monoethanol amide,
5 g of an addition compound of 5 mols of ethylene oxide to 1 mol of xylenol.

(c)
67 g of a 75 weight % solution of di-tallow fatty alkylmonomethyl-trioxethylammonium chloride,
10 g of an addition compound of 5 mols of ethylene oxide to 1 mol of xylenol,
5 g of butyl diglycol,
13 g of isopropanol,
5 g of an addition compound of 5 mols of ethylene oxide to 1 mol of coconut fatty acid monoethanol amide.

(d)
67 g of a 75 weight % solution of di-tallow fatty alkylmonomethyl-pentaoxethylammonium chloride,
10 g of an addition compound of 5 mols of ethylene oxide to 1 mol of xylenol,
5 g of an addition compound of 5 mols of ethylene oxide to 1 mol of coconut fatty acid ethanol amide,
13 g of isopropanol,
5 g of butyl diglycol.

(e)
67 g of a 75 weight % solution of di-tallow fatty alkylmonomethyl-decaoxethylammonium chloride in isopropanol,
10 g of an addition compound of 5 mols of ethylene oxide to 1 mol of xylenol,
5 g of ethylene glycol,
13 g of isopropanol,
5 g of an addition compound of 7.5 mols of ethylene oxide to 1 mol of tallow fatty acid monoethanol amide, (f)
67 g of a 75 weight % solution of di-tallow fatty monomethyl-pentaoxethylammonium chloride in isopropanol,
10 g of an addition compound of 5 mols of ethylene oxide to 1 mol of xylenol,
7 g of ethylene glycol, 10 g of isopropanol,
6 g of an addition compound of 7.3 mols of ethylene oxide to 1 mol of tallow fatty acid monoethanol amide, (g)
67 g of a 75 weight % solution of di-tallow fatty alkylmonomethyl-heptaoxethylammonium chloride,
17 g of ethylene glycol,
6 g of isopropanol,
5 g of an addition compound of 5 mols of ethylene oxide to 1 mol of coconut fatty acid monoethanol amide,
5 g of an addition compound of 5 mols of ethylene oxide to 1 mol of xylenol.

(h)
66 g of a 75 weight % solution of distearlyalkyl-dimethylammonium chloride in isopropanol/water (60:40),
10 g of an addition compound of 5 mols of ethylene oxide to 1 mol of xylenol,
14 g of isopropanol,
5 g of butyl diglycol,
5 g of an addition compound of 7.3 mols of ethylene oxide to 1 mol of tallow fatty acid monoethanol amide, (i)
66 g of a 75 weight % solution of distearylalkyl-dimethylammonium chloride in isopropanol/water (60:40),
10 g of ethylene glycol,
14 g of isopropanol,
5 g of an addition compound of 5 mols of ethylene oxide to 1 mol of xylenol,
5 g of an addition compound of 7.3 mols of ethylene oxide to 1 mol of tallow fatty acid monoethanol amide.

(j)
48.5 g of a 75 weight % solution of dicoconut alkyl-dimethylammonium chloride in isopropanol/water,
35.5 g of an addition compound of 5 mols of ethylene oxide to 1 mol of coconut fatty acid monoethanol amide,
5 g of 1,2-propanediol,
1 g of perfume and dyestuffs,
5 g of an addition compound of 5 mols of ethylene oxide to 1 mol of xylenol,
5 g of isopropanol.

(k)
48.5 g of a 75 weight % solution of dicoconut alkyl-dimethylammonium chloride in isopropanol/water,
35.5 g of an addition compound of 7 mols of ethylene oxide to 1 mol of tallow fatty acid monoethanol amide,
5 g of 1,2-propanediol,
5 g of isopropanol,
1 g of perfume and dyestuffs,
5 g of an addition compound of 5 mols of ethylene oxide to 1 mol of xylenol.

(l)
48.5 g of a 75 weight % solution of di-tallow alkyl-monomethylmonooxopropylammonium chloride in isopropanol/water,
35.5 g of an addition compound of 5 mols of ethylene oxide to 1 mol of coconut fatty acid monoethanol amide,
5 g of 1,2-propanediol,
5 g of isopropanol,
5 g of an addition compound of 5 mols of ethylene oxide to 1 mol of xylenol,
1 g of perfume and dyestuffs.

(m)
48.5 g of a 75 weight % solution of di-tallow alkyl-monomethylmonooxopropylammonium chloride in isopropanol/water,
35.5 g of an addition compound of 7 mols of ethylene oxide to 1 mol of tallow fatty acid alkylmonoethanol amide,
5 g of 1,2-propanediol,
1 g of perfume and dyestuffs.
5 g of an addition compound of 1 mol of ethylene oxide to 1 mol of xylenol,
5 g of isopropanol.

(o)
48.5 g of a 70 weight % solution of di-tallow alkyl-dimethylammonium chloride in isopropanol/water,
35.5 g of an addition compound of 5 mols of ethylene oxide to 1 mol of coconut fatty acid monoethanol amide,
5 g of 1,2-propanediol,
1 g of perfume and dyestuffs,
5 g of isopropanol,
5 g of an addition compound of 1 mol of ethylene oxide to 1 mol of xylenol.

(p)
48.5 g of a 70 weight % solution of di-tallow alkyl-dimethylammonium chloride in isopropanol/water,
35.5 g of an addition compound of 7 mols of ethylene oxide to 1 mol of tallow fatty acid alkylmonoethanol amide,
5 g of 1,2-propanediol,
1 g of perfume and dyestuffs.
5 g of isopropanol,
5 g of an addition compound of 1 mol of ethylene oxide to 1 mol of xylenol.

(q)
48.5 g of a 75 weight % solution of 1-tallow alkylamidoethyl-2-tallow alkyl-3-methylimidazolinium methosulfate in isopropanol,
35.5 g of an addition compound of 5 mols of ethylene oxide to 1 mol of coconut fatty acid alkyl monoethanol amide,
5 g of 1,2-propanediol,
1 g of perfume and dyestuffs;
5 g of isopropanol,
5 g of an addition compound of 1 mol of ethylene oxide to 1 mol of xylenol.

(r)
48.5 g of a 75 weight % solution of 1-tallow alkylamidoethyl-2-tallow alkyl-3-methylimidazolinium methosulfate in isopropanol,
35.5 g of an addition compound of 7 mols of ethylene oxide to 1 mol of tallow fatty acid alkyl monoethanol amide,
5 g of 1,2-propanediol,
1 g of perfume and dyestuffs.
5 g of isopropanol,
5 g of an addition compound of 1 mol of ethylene oxide to 1 mol of xylenol.

The utilitarian properties of the products sub (a)–(r), as regards their dispersibility in cold water and the feel, which they impart to textiles treated therewith, correspond to those of the fabric softener concentrate according to Example 1.

What is claimed is:

1. Fabric softener concentrates, which contain from:

(a) 30 to 70 weight % of a cationic softener of the formulae:

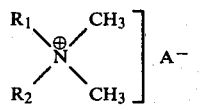

I

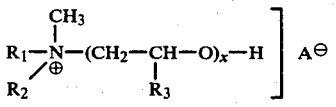

II

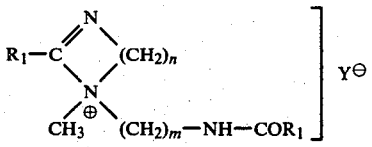

III the symbols in the above formulae having the following meanings:

$R_1$ and $R_2$ each denotes alkyl or alkenyl of from 8 to 20 carbon atoms, $R_3$ is hydrogen or alkyl of from 1 to 3 carbon atoms, x is an integer of from 1 to 5, m and n each is 2 or 3, $A^-$ is chlorine or bromine, and $Y^-$ is methosulfate;

(b) 5 to 50 weight % of a non-ionic softener of the formula:

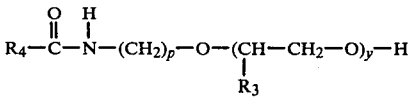

IV wherein $R_4$ is alkyl or alkenyl of from 8 to 22 carbon atoms, $R_3$ is hydrogen or alkyl of from 1 to 3 carbon atoms, p is an integer of from 1 to 5 and Y is an integer of from 1 to 15, (c) 5 to 20 weight % of an oxethylated alkyl phenol or fatty alcohol, (d) 5 to 30 weight % of a $C_1$–$C_3$alkanol, (e) 5 to 30 weight % of butyl diglycol, ethylene glycol or 1,2-propanediol and (f) water and optionally perfume and dyestuffs in quantities representing the remainder to 100 weight %.

2. Fabric softener concentrates according to claim 1 which contain of from 40 to 50 weight % of component (a), 30 to 40 weight % of component (b), 5 to 10 weight % of component (c), 5 to 10 weight % of component (d), 5 to 50 weight % of component (e) and water and optionally perfume and dyestuffs in quantities representing the remainder to 100 weight %.

* * * * *